US008528259B1

(12) United States Patent
Heirtzler et al.

(10) Patent No.: US 8,528,259 B1
(45) Date of Patent: Sep. 10, 2013

(54) METHOD OF ADJUSTING DOOR GLASS CROSS CAR FOR FRAMELESS WINDOW SYSTEMS

(75) Inventors: Paul L. Heirtzler, Northville, MI (US); Donald P. Iacovoni, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/551,813

(22) Filed: Jul. 18, 2012

(51) Int. Cl.
*E05F 11/00* (2006.01)

(52) U.S. Cl.
USPC ..... 49/506; 49/212

(58) Field of Classification Search
USPC ..... 49/212, 348, 349, 352, 506
See application file for complete search history.

(56) References Cited

U.S. PATENT DOCUMENTS

| | | | | |
|---|---|---|---|---|
| 4,956,942 | A | 9/1990 | Lisak et al. | |
| 5,430,976 | A | 7/1995 | Wirsing | |
| 5,694,719 | A * | 12/1997 | Bejune et al. | 49/502 |
| 5,927,021 | A | 7/1999 | Kowalski et al. | |
| 5,960,588 | A * | 10/1999 | Wurm et al. | 49/352 |
| 6,425,208 | B1 | 7/2002 | Klueger et al. | |
| 7,043,878 | B2 * | 5/2006 | Cardine et al. | 49/212 |
| 7,246,464 | B2 * | 7/2007 | Castellon | 49/212 |
| 7,467,494 | B2 * | 12/2008 | Buchta | 49/352 |
| 7,640,697 | B2 | 1/2010 | Florentin et al. | |
| 7,798,563 | B2 | 9/2010 | Kapadia et al. | |
| 7,878,287 | B2 | 2/2011 | Buchwitz et al. | |
| 8,069,610 | B2 * | 12/2011 | Graf et al. | 49/348 |
| 8,127,493 | B2 * | 3/2012 | Cappelli et al. | 49/212 |
| 2003/0066243 | A1 * | 4/2003 | Cardine et al. | 49/212 |
| 2005/0155290 | A1 | 7/2005 | Cardine et al. | |
| 2007/0214726 | A1 * | 9/2007 | Graf et al. | 49/352 |
| 2008/0148647 | A1 | 6/2008 | Pavlovic | |

FOREIGN PATENT DOCUMENTS

DE 10014946 A1 * 9/2001

* cited by examiner

*Primary Examiner* — Jerry Redman
(74) *Attorney, Agent, or Firm* — Jason Rogers

(57) ABSTRACT

A method for adjusting the position of side door windows, in a cross car direction is provided. The method including the steps of providing one or more guide rails positioned within a side door of a vehicle, the guide rails are configured to guide the movement and position of the side door windows, each guide rail has a guide rail bracket configured for seating against a door bracket, attaching the door brackets to portions of the side door, positioning a locator fixture such as to extend through the door bracket, seating the guide rail bracket over the door bracket and over the locator fixture such that the guide rail bracket and the locator fixture mate in a desired fore and aft position relative to the side door and also in a desired cross-car location relative to the side door and fastening the guide rail bracket to the door bracket.

20 Claims, 4 Drawing Sheets

METHOD OF ADJUSTING DOOR GLASS CROSS CAR FOR FRAMELESS WINDOW SYSTEMS

BACKGROUND

In some vehicles, a side door includes a structural member that extends around the top of the side door window. The structural member is commonly referred to as a door frame. The door frame often provides support for weather seals, which in turn, provide support and sealing functions for the side door window when the side door window is in raised position.

Other vehicles, such as for example convertibles, have a frameless door system. That is, the side door does not have a structural member that extends around the top of the side door window. Frameless door systems are used to provide an unobstructed view from the vehicle interior when the side door window is in a lowered position. Frameless door systems can also be used to achieve desired styling objectives.

Since frameless systems do not have a structural member extending around the top of the side door window, movement and positioning of the side door window is supported by structures or mechanisms contained within the vehicle door. In certain cases, the movement and positioning of the side door window is controlled and supported by a regulator. A regulator is a mechanism that controls the raising, lowering, and positioning of the side door window. Typically, a regulator includes one or more rails, clamps configured to ride on the rails and further configured to secure the side door window, and cables configured to move the clamps on the rails as directed by a motor assembly.

In certain frameless systems, the weather seals are mounted to the vehicle body. Mounting the weather seals to the vehicle body can lead to variations in the relative positioning of the side door windows and the weather seals. As a result of the variations in the relative positioning, it can be time consuming to position a regulator such that the side door window obtains a proper seal against a weather seal. In order to ensure proper engagement of the side door window with the weather seals, it is desirable to provide adjustments with the structures and mechanisms, such as for example regulators, that control the movement and positioning of the side door windows.

It would be advantageous if the structures and mechanisms that control the movement and positioning of side door windows could be installed in vehicle doors more efficiently.

SUMMARY OF THE INVENTION

According to this invention, there is provided a method for adjusting the position of side door windows, in a cross car direction. The method including the steps of: providing one or more guide rails positioned within a side door of a vehicle, the guide rails being configured to guide the movement and position of the side door windows as the side door windows are raised and lowered, each guide rail having a guide rail bracket, each guide rail bracket being configured for seating against a door bracket; attaching the door brackets to portions of the side door; positioning a locator fixture such as to extend through the door bracket; seating the guide rail bracket over the door bracket and over the locator fixture such that the guide rail bracket and the locator fixture mate in a desired fore and aft position relative to the side door and also in a desired cross-car location relative to the side door; and fastening the guide rail bracket to the door bracket.

According to this invention, there is also provided a method for adjusting the position of side door windows, in a cross car direction. The method includes the steps of: providing one or more guide rails positioned within a side door of a vehicle, the guide rails being configured to guide the movement and position of the side door windows as the side door windows are raised and lowered, each guide rail having a guide rail bracket; attaching a door bracket to each guide rail bracket, the door bracket being configured for attachment to portions of the side door; positioning a locator fixture such as to extend through the door bracket; seating the guide rail bracket over the door bracket and over the locator fixture such that the guide rail bracket and the locator fixture mate in a desired fore and aft position relative to the side door and also in a desired cross-car location relative to the side door; and fastening the guide rail bracket to the door bracket.

According to this invention, there is also provided a method for adjusting the position of side door windows, in a cross car direction. The method includes the steps of: providing one or more guide rails positioned within a side door of a vehicle, the guide rails being configured to guide the movement and position of the side door windows as the side door windows are raised and lowered, each guide rail having a guide rail bracket, each guide rail bracket being configured for seating against portions of a side door; positioning a locator fixture in the side door in a desired fore and aft and a desire cross car location; seating the guide rail bracket over the locator fixture such that the guide rail bracket and the locator fixture mate; and fastening the guide rail bracket to the door bracket.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

DETAILED DESCRIPTION OF THE INVENTION

The present invention will now be described with occasional reference to the specific embodiments of the invention.

This invention may, however, be embodied in different forms and should not be construed as limited to the embodiments set forth herein. Rather, these embodiments are provided so that this disclosure will be thorough and complete and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, methods are provided for adjusting the position of side door windows, in a cross car direction, for frameless window systems. The term "frameless window system", as used herein, is defined to mean any vehicle door window system not having a structural member that extends around the top of the side door window. The term "cross car direction", as used herein, is defined to mean a direction substantially parallel to the direction extending from one front tire to the other front tire. The term "fore and aft direction", as used herein, is defined to mean a direction substantially parallel to the direction extending from one front tire to the rear tire on the same side of the vehicle.

Figure 1:
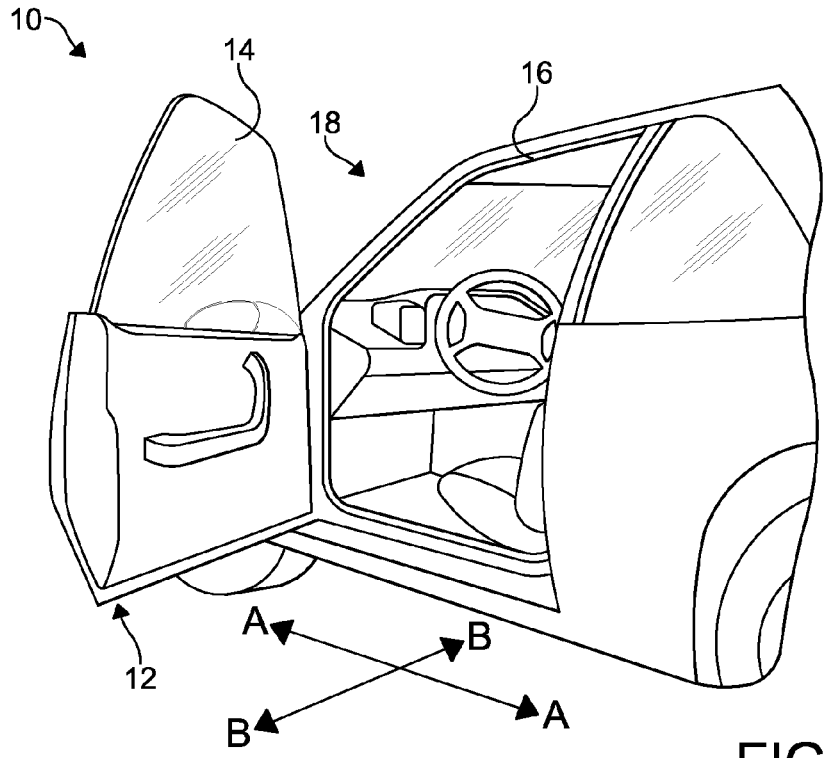
FIG. 1 is a schematic view of a vehicle having a movable, frameless window assembly in a side door.

Referring now to FIG. 1, a vehicle 10 includes a side door 12 that is hinged relative to the vehicle 10 such as to open in the conventionally known manner. The side door 12 includes a frameless side door window 14 that engages a peripheral seal 16 extending around a periphery of a side door window opening 18 when the side door 12 is in the closed position (not shown).

Referring again to FIG. 1, a fore and aft direction is illustrated by the direction arrows A-A and a cross-car direction is illustrated by the direction arrows B-B.

Figure 2:
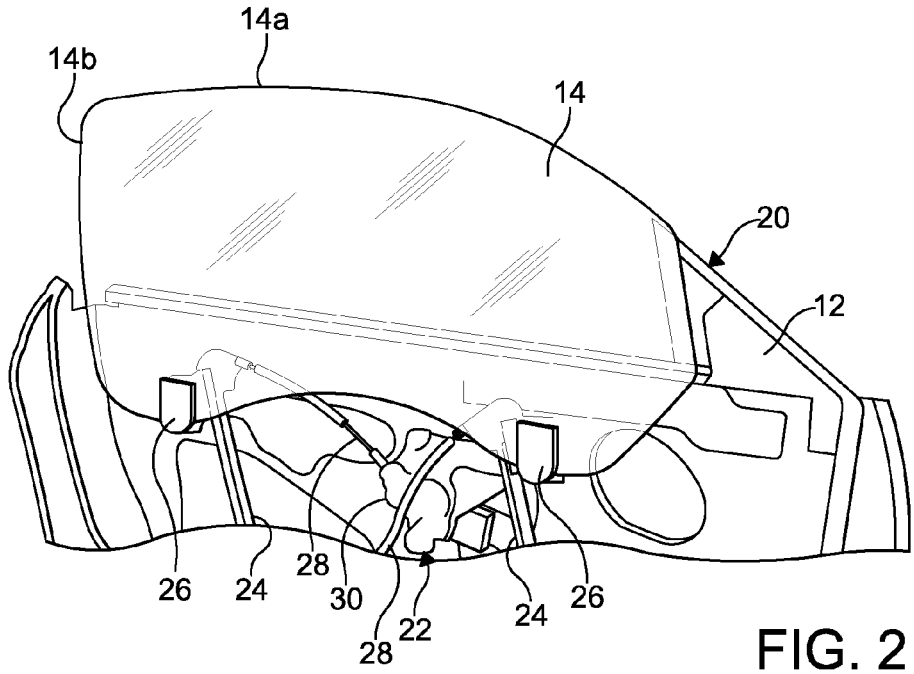
FIG. 2 is a schematic view of the vehicle door and frameless window system of FIG. 1.

Referring now to FIG. 2, a movable side door window assembly 20 is illustrated. The side door window assembly 20 includes the frameless side door window 14 and an electrically powered regulator 22. The regulator 22 includes one or more guide rails 24 and one or more clamping mechanisms 26 configured to ride on the guide rails 24. The clamping mechanisms 26 are further configured to be secured to the side door window 14. The regulator 22 also includes a plurality of cables 28 configured to move the clamping mechanisms 26 on the guide rails 24 as directed by a motor assembly 30. While the embodiment of the regulator 22 illustrated in FIG. 2 shows a quantity of two guide rails 24, it should be appreciated that in other embodiments, the regulator may only have one guide rail or the regulator may have more than two guide rails.

Figure 3:
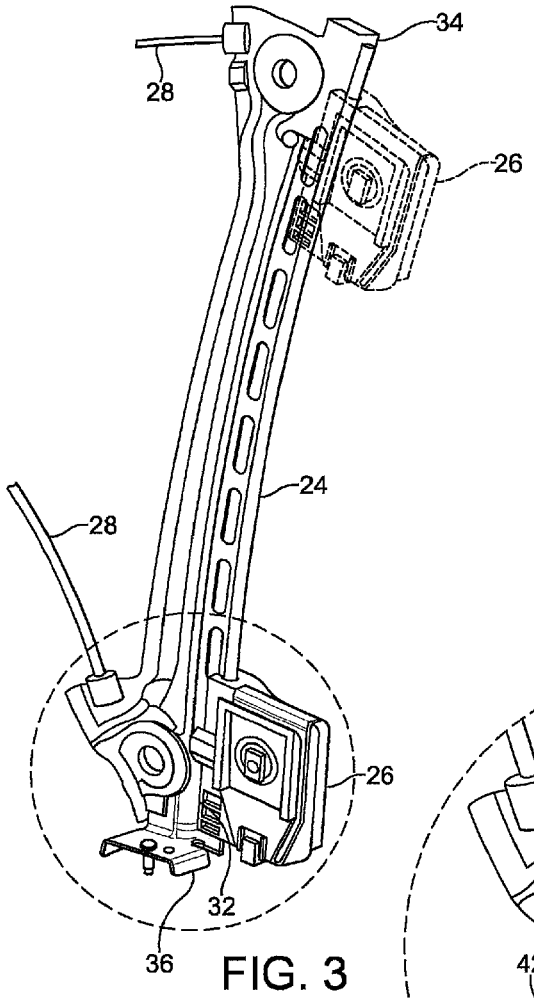
FIG. 3 is a schematic view of a guide rail of the movable frameless window system of FIG. 2.

Referring now to FIG. 3, one of the guide rails 24 is illustrated. The guide rail 24 includes a lower end 32 and an upper end 34. The clamping mechanism 26 is first shown at the lower end 32 of the guide rail 24 (in the position where the side door window 14 is in a lowered position) and also shown (in phantom) at the upper end 34 of the guide rail 24 (in the position where the side door window 14 is in a raised position).

Figure 4:
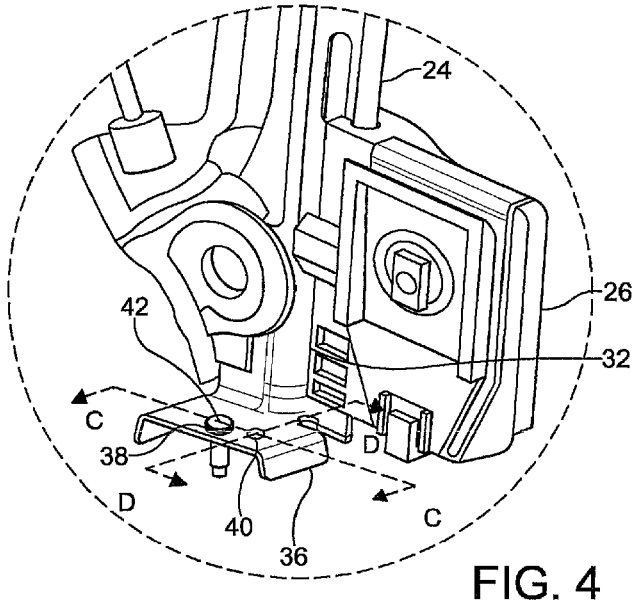
FIG. 4 is an expanded schematic view of a portion of the guide rail of FIG. 3 illustrating a guide rail bracket.

Referring now to FIGS. 3 and 4, a guide rail bracket 36 extends from the lower end 32 of the guide rail 24. As will be explained in more detail below, during the installation of the regulator 22 into the side door 12 of the vehicle (not shown), the guide rail bracket 36 is configured to mate with a corresponding door bracket 44 (see FIGS. 5, 6, and 7, thereby positioning the guide rail 24 in a desired position. Referring now to FIG. 4, cross-sectional line C-C equates to the fore and aft direction as indicated by line A-A shown in FIG. 1 and cross-sectional line D-D equates to the cross-car direction as indicated by line B-B shown in FIG. 1. The guide rail bracket 36 includes a first aperture 38 and a second aperture 40. In the embodiment illustrated in FIG. 4, the first and second apertures 38 and 40 are positioned such as to be co-linear on cross-sectional line C-C. However, in other embodiments, the first and second apertures 38 and 40 need not be co-linear on the cross-sectional line C-C. As will be explained in more detail below, the first aperture 38 is configured to receive a bracket fastener 42 and the second aperture 40 is configured to receive a locating pin (not shown).

While the guide rail bracket 36 is shown in FIGS. 3 and 4 as a unitary extension of the guide rail 24, it should be appreciated that in other embodiments, the guide rail bracket 36 can be a separate and distinct component that is assembled to the guide rail 24.

Figure 5:
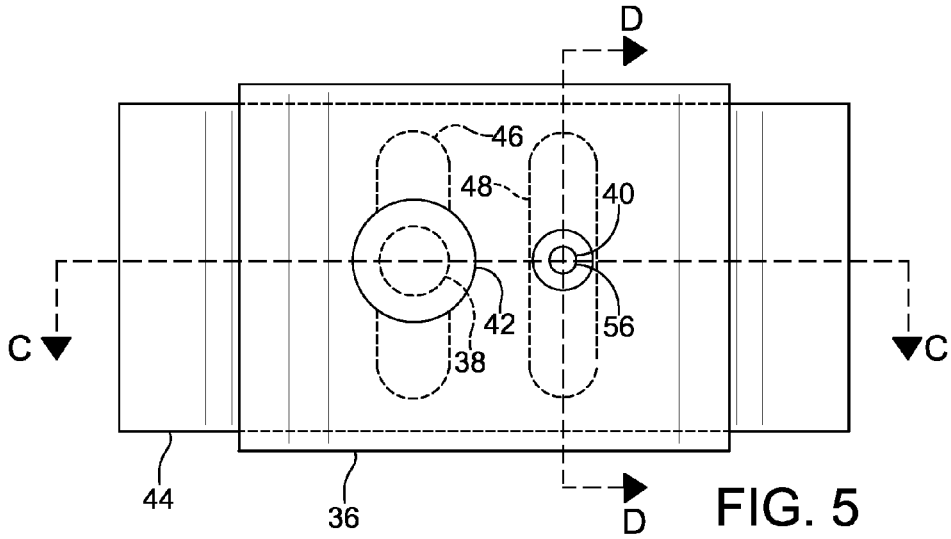
FIG. 5 is a plan view of the guide rail bracket of FIG. 3 shown in a seated position over a door bracket.
Figure 6:
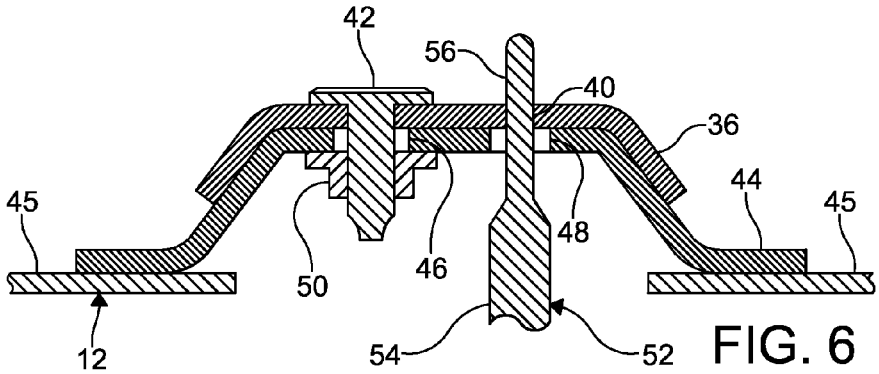
FIG. 6 is a cross-sectional view, in elevation, of the guide rail bracket and the door bracket of FIG. 5 taken along the line C-C.
Figure 7:
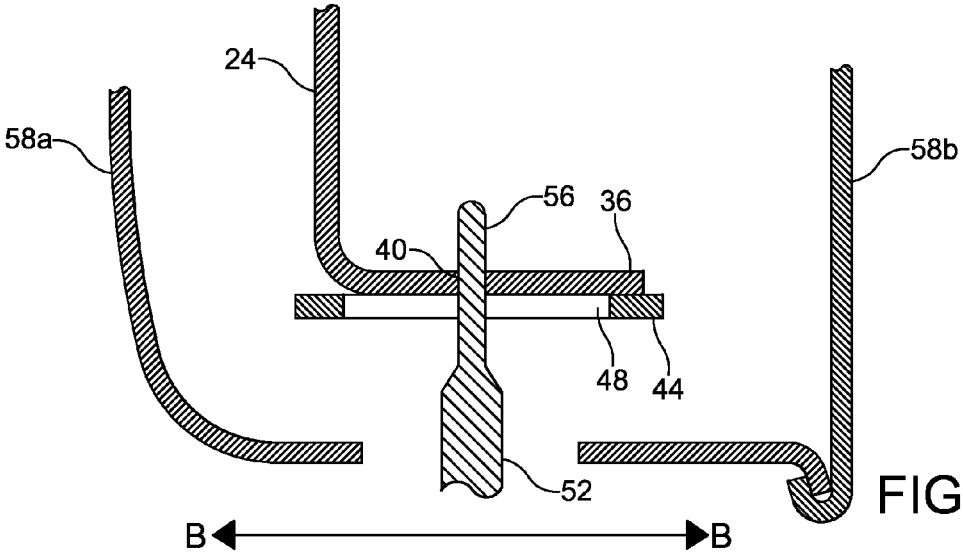
FIG. 7 is a cross-sectional view, in elevation, of the guide rail bracket and the door bracket of FIG. 5 taken along line D-D shown in an installed position within a portion of a side door.

Referring now to FIGS. 5-7, the guide rail bracket 36 is illustrated in an installed position over a door bracket 44. Referring to FIG. 6, the door bracket 44 can be fixed to portions of the bottom 45 of a side door 12 in any desired manner. Referring now to FIGS. 5 and 6, the guide rail bracket 36 includes the first aperture 38 and the second aperture 40. The door bracket 44 includes a first slot 46 and a second slot 48. As will be explained in more detail below, in the installed position, the first slot 46 in the door bracket 44 and the first aperture 38 in the guide rail bracket 36 substantially align, thereby allowing the bracket fastener 42 to pass through the guide rail bracket 36 and the door bracket 44 and connect to a bracket retainer 50. The bracket fastener 42 and the bracket retainer 50 are configured to secure the guide rail bracket 36 to the door bracket 44 after the guide rail bracket 36 and the door bracket 44 are aligned as desired. In the illustrated embodiment, the bracket fastener 42 is a threaded fastener and the bracket retainer 50 is a threaded nut. However in other embodiments, the bracket fastener 42 and the bracket retainer 50 can be other mechanisms, devices, or structures, such as, for example, clips or clamps, sufficient to secure the guide rail bracket 36 to the door bracket 44 after the guide rail bracket 36 and the door bracket 44 are aligned as desired.

Referring again to FIGS. 5 and 6, in a similar fashion, in an installed position the second slot 48 in the door bracket 44 and the second aperture 40 in the guide rail bracket 36 substantially align, thereby allowing a locator fixture, such as the illustrated locating pin 52, to pass from under the door bracket 44, through the door bracket 44 and through the guide rail bracket 36. The locator fixture 52 will be discussed in more detail below.

Referring now to FIG. 6, the guide rail bracket 36 and the door bracket 44 optionally have a cross-sectional shape in the form of an expanded "U". The expanded U-shaped cross-sectional shapes allow the guide rail bracket 36 to seat on the door bracket 44 and substantially fix the position of the guide rail bracket 36 relative to the side door 12 in a fore and aft direction. Fixing the fore and aft position of the guide rail bracket 36 relative to the side door 12 provides a desired fore and aft location for the side door window 14. While the embodiment illustrated in FIG. 6 is shown with the optional U-shaped cross-sectional shapes of the guide rail bracket 36 and the door bracket 44, it should be understood that other structures, mechanisms, and devices can be used to fix the relative fore and aft position of the guide rail bracket 36 relative to the side door 12. Accordingly, the methods for adjusting the position of side door windows, in a cross car direction, for frameless window systems can be practiced without the guide rail bracket 36 and the door bracket 44 having U-shaped cross-sectional shapes.

Referring again to FIG. 5, the locator fixture 52 is used to position the guide rail bracket 36 in a cross-car direction relative to the door bracket 44. The locator fixture 52 is located along the second slot 48 in a known cross-car position such that the location of the guide rail bracket 36, and subsequently the guide rail 24 and side door window 14, ensure a desired engagement of the side door window 14 with other side door window structures, such as for example weather seals. While the locator fixture 52 is located in the known cross-car position, it is within the contemplation of this invention that the location of the locator fixture 52 relative to the side door 14 can be adjusted as necessary to accommodate various build conditions, various window configurations and various window structures.

Referring again to FIG. 6, the locator fixture 52 includes a body 54 and an extension segment 56. The extension segment 56 is configured to extend through the second slot 48 of the door bracket 44 and through the second aperture 40 of the guide rail bracket 36. The extension segment 56 has a circular cross-sectional shape and a diameter that respectively correspond to the circular cross-sectional shape and diameter of the second aperture 40 in the guide rail bracket 36. The circular cross-sectional shapes and diameters of the extension segment 56 and the second aperture 40 are configured to provide an accurate mating of the guide rail bracket 36 with the locator fixture 52, thereby ensuring the desired cross-car positioning of the guide rail bracket 36 relative to the door bracket 44. While the illustrated embodiment shows the extension segment 56 and the second aperture 40 as each having a circular cross-sectional shape, it should be appreciated that in other embodiments, the extension segment 56 and the second aperture 40 can have other desired cross-sectional shapes, such as, for example, square cross-sectional shapes, sufficient that the extension segment 56 and the second aperture 40 provide an accurate mating of the guide rail bracket 36 with the locator fixture 52.

In certain embodiments, the locator fixture 52 is a temporary structure that can be positioned in the side door 12 during assembly of the vehicle. Once the guide rail bracket 36 is secured to the door bracket 44, the locator fixture 52 can be removed from the side door 12. In other embodiments, the locator fixture 52 can be a permanent structure that remains within the side door 12 after the guide rail bracket 36 has been secured to the door bracket 44.

Referring now to FIG. 7, an inner portion 58*a* and an outer portion 58*b* of the side door 12 are illustrated. The guide rail 24 is shown with the guide rail bracket 36. The guide rail bracket 36 is seated on the door bracket 44. The door bracket 44 includes the second slot 48. The extension segment 56 of the locator fixture 52 extends through the second slot 48 and through the second aperture 40 in the guide rail bracket 36. In one scenario, prior to seating of the guide rail bracket 36 on the extension segment 56 of the locator fixture 52, the locator fixture 52 is positioned along the second slot 48 in the desired cross-car location as described above. The guide rail bracket 36 is positioned along the cross-car direction, as shown by direction arrows B-B.

While use of the locator fixture 52 has been described in detail above as one process having certain installation steps, it should be appreciated that the locator fixture can be used in other processes having other installation steps. Referring again to FIG. 7 as one non-limiting example of another process having other installation steps, the order of the installation of the various components can be changed such that the guide rail bracket 36 is seated on the door bracket 44 in a relatively random cross car orientation. Next, the extension segment 56 of the locator fixture 52 is inserted into the second aperture 40 in the guide rail bracket 36. Finally, the locator fixture 52 and the attached guide rail bracket 36 are simultaneously moved to a desired location.

The use of the locator fixture 52 to ensure the desired cross-car positioning of the guide rail bracket 36 relative to the door bracket 44 advantageously provides several benefits, although all of the benefits may not be present in all embodiments. First, the use of the locator fixture 52 advantageously eliminates the need to manually set the position of each regulator within each side door of each vehicle, thereby reducing labor costs and improving manufacturing capability. Second, the use of the locator fixture 52 is advantageously suited for high volume, lean manufacturing environments. Third, if conditions warrant, the location of the locator fixture 52 relative to the side door 14 can be easily adjusted as necessary to accommodate various build conditions, various window configurations and various window structures.

Figure 8:
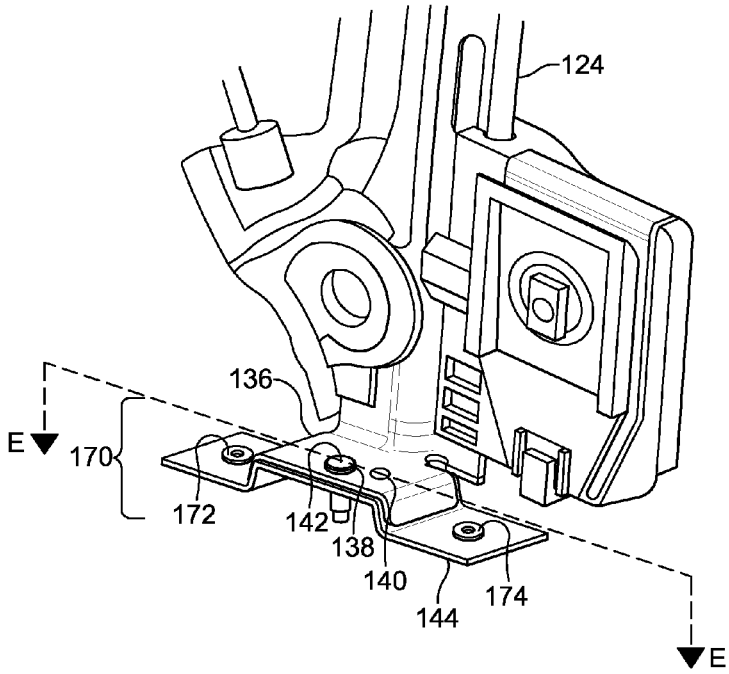
FIG. 8 is an expanded schematic view of a portion of a guide rail illustrating an alternate embodiment of a guide rail bracket and door bracket.
Figure 9:
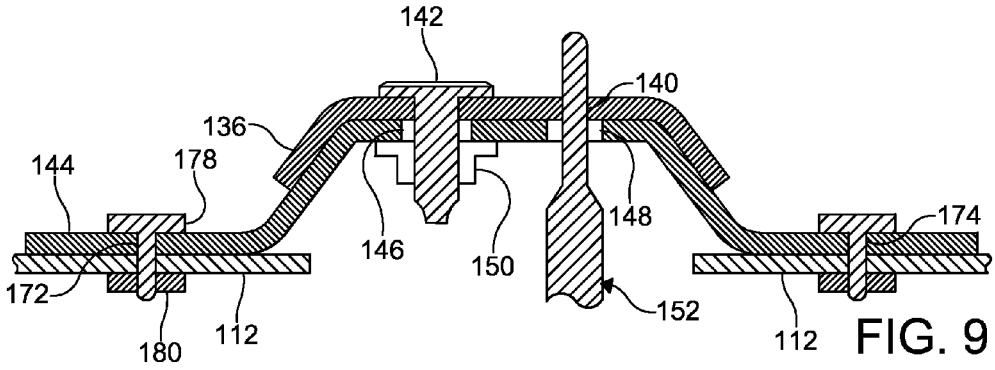
FIG. 9 is a cross-sectional view, in elevation, of the guide rail bracket and the door bracket of FIG. 8 taken along the line E-E.

While the embodiment of the method for adjusting the position of side door windows 14, in a cross car direction, for frameless window systems shown in FIGS. 5-7 has been described above as seating the guide rail bracket 36 to an installed door bracket 44 by use of the locator fixture 52, it should be appreciated that in other embodiments, other structures and methods can be used. Referring now to FIGS. 8 and 9, an alternate embodiment is illustrated. Referring first to FIG. 8, a guide rail 124 includes a guide rail bracket 136. The guide rail bracket 136 includes a first aperture 138 and a second aperture 140. In the illustrated embodiment, the guide rail 124, guide rail bracket 136, first aperture 138 and second aperture 140 are the same as, or similar to, the guide rail 24, guide rail bracket 36, first aperture 38 and second aperture 40 illustrated in FIG. 4 and described above. However, in other embodiments, the guide rail 124, guide rail bracket 136, first aperture 138 and second aperture 140 can be different than the guide rail 24, guide rail bracket 36, first aperture 38 and second aperture 40. As shown in the embodiment of FIG. 8, a door bracket 144 is attached to the guide rail bracket 136 prior to the installation of the regulator (not shown) in the side door (not shown). The door bracket 144 is attached to the guide rail bracket 136 using a fastener 142 and bracket retainer 150 in the same manner as described above for fastener 42 and bracket retainer 50. Attaching the guide rail bracket 136 to the door bracket 144 forms a rail bracket assembly 170.

Referring again to FIG. 8, the door bracket 144 has a door bracket first aperture 172 and a door bracket second aperture 174. The door bracket first and second apertures 172 and 174 will be discussed in more detail below.

Referring now to FIG. 9, the door bracket 144 includes a first slot 146 and a second slot 148. In the assembled position, the first slot 146 in the door bracket 144 and the first aperture 138 in the guide rail bracket 136 substantially align, thereby allowing the bracket fastener 142 to pass through the guide rail bracket 136, through the door bracket 144, connect to a bracket retainer 150. In a similar fashion, in an assembled position the second slot 148 in the door bracket 144 and the second aperture 140 in the guide rail bracket 136 substantially align, thereby allowing a locating fixture 152 to pass from under the door bracket 144, through the door bracket 144 through the guide rail bracket 136. In the illustrated embodiment, the locator fixture 152 is the same as, or similar to, the locator fixture 52 illustrated in FIG. 6 and described above. In other embodiments, the locator fixture 152 can be different than the locator fixture 52.

Referring again to FIG. 9, the locator fixture 152 is used to position the rail bracket assembly 170 in a cross-car direction relative to portions of the side door 112. The locator fixture 152 is located along the second slot 148 in a known cross-car position such that the location of the rail bracket assembly 170 ensures a desired engagement of the side door window (not shown) with other side door window structures, such as for example weather seals.

Once the rail bracket assembly 170 is positioned in the desired cross-car location, the rail bracket assembly 170 is attached to the side door 112 by fasteners 178 extending through the first and second apertures 172 and 174 of the door bracket 144 and connected to retainers 180. In the illustrated embodiment, the fasteners 178 and retainers 180 can be any desired mechanism, such as for example a threaded bolt and nut, sufficient to secure the rail bracket assembly 170 in the desired cross-car location.

While the embodiment shown in FIGS. 8 and 9 illustrate the guide rail bracket 136 attached to a discrete door bracket 144, it should be appreciated that in other embodiments the guide rail bracket 136 and the door bracket 144 can be formed as a unitary structure, thereby incorporating the mounting provisions of the door bracket 144. In this scenario, the resulting guide rail bracket 136 can be fastened to portions of the side door in manners similar as that described above.

While the various embodiments of the methods for adjusting the position of side door windows, in a cross car direction, for frameless window systems illustrated in FIGS. 1-9 have been shown in the context of a regulator having one or more guide rails, it should be appreciated that certain regulators do not use rails. Rather, the side door window is only guided by structures, such as for example, one or more glass run seal channels positioned along the front and rear edges of the side door window. In these embodiments, the methods for adjusting the position of side door windows, as described herein, can be applied to position the bottom of the glass run seal channels in the same manners as discussed above.

The principles and mode of operation of the methods for adjusting the position of side door windows, in a cross car direction, for frameless window systems have been described in its preferred embodiments. However, it should be noted that the methods for adjusting the position of side door windows, in a cross car direction, for frameless window systems may be practiced otherwise than as specifically illustrated and described without departing from its scope.

What is claimed is:

1. A method for adjusting a position of a side door window, in a cross car direction, the method comprising the steps of:

providing a guide rail within a side door of a vehicle, the guide rail configured to guide movement and position of the side door window as the side door window is raised and lowered, the guide rail having a guide rail bracket, the guide rail bracket configured for seating against a door bracket;

attaching the door bracket to the side door;

positioning a locator fixture such as to extend through the door bracket;

seating the guide rail bracket over the door bracket and over the locator fixture such that the guide rail bracket and the locator fixture mate in a desired fore and aft position relative to the side door and also in a desired cross-car location relative to the side door;

fastening the guide rail bracket to the door bracket; and removing the locator fixture from the side door once the guide rail bracket is fastened to the door bracket.

2. The method of claim 1, wherein the vehicle has a frameless window system.

3. The method of claim 1, wherein the guide rail bracket is are located at a lower end of the guide rail.

4. The method of claim 1, wherein the guide rail bracket is are separate and distinct components attached to the guide rail.

5. The method of claim 1, wherein the guide rail bracket has a first and second aperture and the door bracket has a first and second slot.

6. The method of claim 5, wherein in an installed position, the first aperture of the guide rail bracket aligns with the first slot of the door bracket, and the second aperture of the guide rail bracket aligns with the second slot of the door bracket.

7. The method of claim 6, wherein the locator fixture mates with the aligned second slot in the door bracket and the second aperture in the guide rail bracket.

8. The method of claim 5, including the step of positioning the locator fixture in a cross-car direction along the second slot in the door bracket to a location to ensure a desired engagement of the side door window with side door window weather seals.

9. The method of claim 1, wherein the guide rail bracket and the door bracket have an expanded U cross-sectional shapes.

10. The method of claim 1, wherein the locator fixture is positioned in a location known to ensure a desired engagement of the side door window with side door window weather seals.

11. The method of claim 1, wherein the locator fixture has a circular cross-sectional shape that corresponds to a circular cross-sectional shape of the second aperture of the guide rail bracket.

12. A method for adjusting a position of a side door window, in a cross car direction, the method comprising the steps of:

providing a guide rail within a side door of a vehicle, the guide rail configured to guide movement and position of the side door window as the side door window is raised and lowered, the guide rail having a guide rail bracket;

attaching a door bracket to the guide rail bracket, the door bracket configured for attachment to a portion of the side door;

positioning a locator fixture such as to extend through the door bracket;

seating the guide rail bracket over the door bracket and over the locator fixture such that the guide rail bracket and the locator fixture mate in a desired fore and aft position relative to the side door and also in a desired cross-car location relative to the side door;

fastening the guide rail bracket to the door bracket; and removing the locator fixture from the side door once the guide rail bracket is fastened to the door bracket.

13. The method of claim 12, wherein the vehicle has a frameless window system.

14. The method of claim 12, wherein the guide rail bracket has a first and second aperture and the door bracket has a first and second slot.

15. The method of claim 14, wherein in an installed position, the first aperture of the guide rail bracket aligns with the first slot of the door bracket, and the second aperture of the guide rail bracket aligns with the second slot of the door bracket.

16. The method of claim 15, wherein the locator fixture mates with the aligned second slot in the door bracket and the second aperture in the guide rail bracket.

17. The method of claim 12, wherein the locator fixture is positioned in a location known to ensure a desired engagement of the side door window with side door window weather seals.

18. A method for adjusting a position of a side door window, in a cross car direction, the method comprising the steps of:

providing a guide rail within a side door of a vehicle, the guide rail configured to guide movement and position of the side door window as the side door window is raised and lowered, the guide rail having a guide rail bracket, the guide rail bracket configured for seating against a portion of a side door;

positioning a locator fixture in the side door in a desired fore and aft and a desired cross car location;

seating the guide rail bracket over the portion of the side door and the locator fixture such that the guide rail bracket and the locator fixture mate;

fastening the guide rail bracket to the portion of the side door; and removing the locator fixture from the side door once the guide rail bracket is fastened to the portion of the side door.

19. A method for adjusting a position of a side door window in a cross car direction, the method comprising the steps of:

providing a guide rail within a side door of a vehicle, the guide rail configured to guide movement and position of a side door window as the side door window is raised and lowered, the guide rail including a guide rail bracket having an aperture formed therethrough;

attaching a door bracket having a slot formed therethrough to the side door;

providing a locator fixture;

seating the guide rail bracket on the door bracket such that the locating fixture extends through the slot in the door bracket and engages the aperture in the guide rail bracket so as to position the guide rail bracket in a desired fore and aft position and in a desired cross-car location relative to the side door; and fastening the guide rail bracket to the door bracket.

20. The method of claim 19, wherein the guide rail bracket has a second aperture formed therethrough, the door bracket has a second slot formed therethrough, and wherein the step of fastening the guide rail bracket to the door bracket is performed by inserting a fastener through the second aperture of the guide rail bracket and the second slot of the door bracket.

* * * * *